United States Patent [19]

Kamp

[11] 4,047,674

[45] Sept. 13, 1977

[54] DEVICE FOR ADJUSTING A RETROGRADE ROTARY MOTION IN A COIL

[75] Inventor: Heinz Kamp, Rickelrath, Germany

[73] Assignee: W. Schlafhorst & Co., Monchen-Gladbach, Germany

[21] Appl. No.: 715,709

[22] Filed: Aug. 19, 1976

[30] Foreign Application Priority Data

Aug. 20, 1975 Germany ..... 2536991

[51] Int. Cl.[2] ..... B65H 54/22; B65H 54/40; B65H 67/08

[52] U.S. Cl. ..... 242/18 DD; 242/35.5 R; 242/35.6 R; 242/35.6 E

[58] Field of Search ..... 242/18 DD, 35.5 R, 35.6 R, 242/35.6 E, 36, 37 R

[56] References Cited

U.S. PATENT DOCUMENTS

| | | | |
|---|---|---|---|
| 2,208,930 | 7/1940 | Kahlisch | 242/35.6 R |
| 2,238,923 | 4/1941 | Abbott | 242/35.6 R |
| 2,338,914 | 1/1944 | Esser et al. | 242/35.6 R |
| 2,407,366 | 9/1946 | Cotchett et al. | 242/35.6 R |
| 3,030,040 | 4/1962 | Reiners | 242/35.6 R |
| 3,033,478 | 5/1962 | Furst | 242/35.6 R |
| 3,224,693 | 12/1965 | Jenny | 242/35.5 R |

*Primary Examiner*—Stanley N. Gilreath
*Attorney, Agent, or Firm*—Herbert L. Lerner

[57] ABSTRACT

Winding equipment for textile coils includes a device for adjusting retrograde rotary motion in a coil being frictionally driven by a winding cylinder. The device has reduction gearing, and means for inserting said reduction gearing between the winding cylinder and the coil.

6 Claims, 3 Drawing Figures

DEVICE FOR ADJUSTING A RETROGRADE ROTARY MOTION IN A COIL

Figure 1:
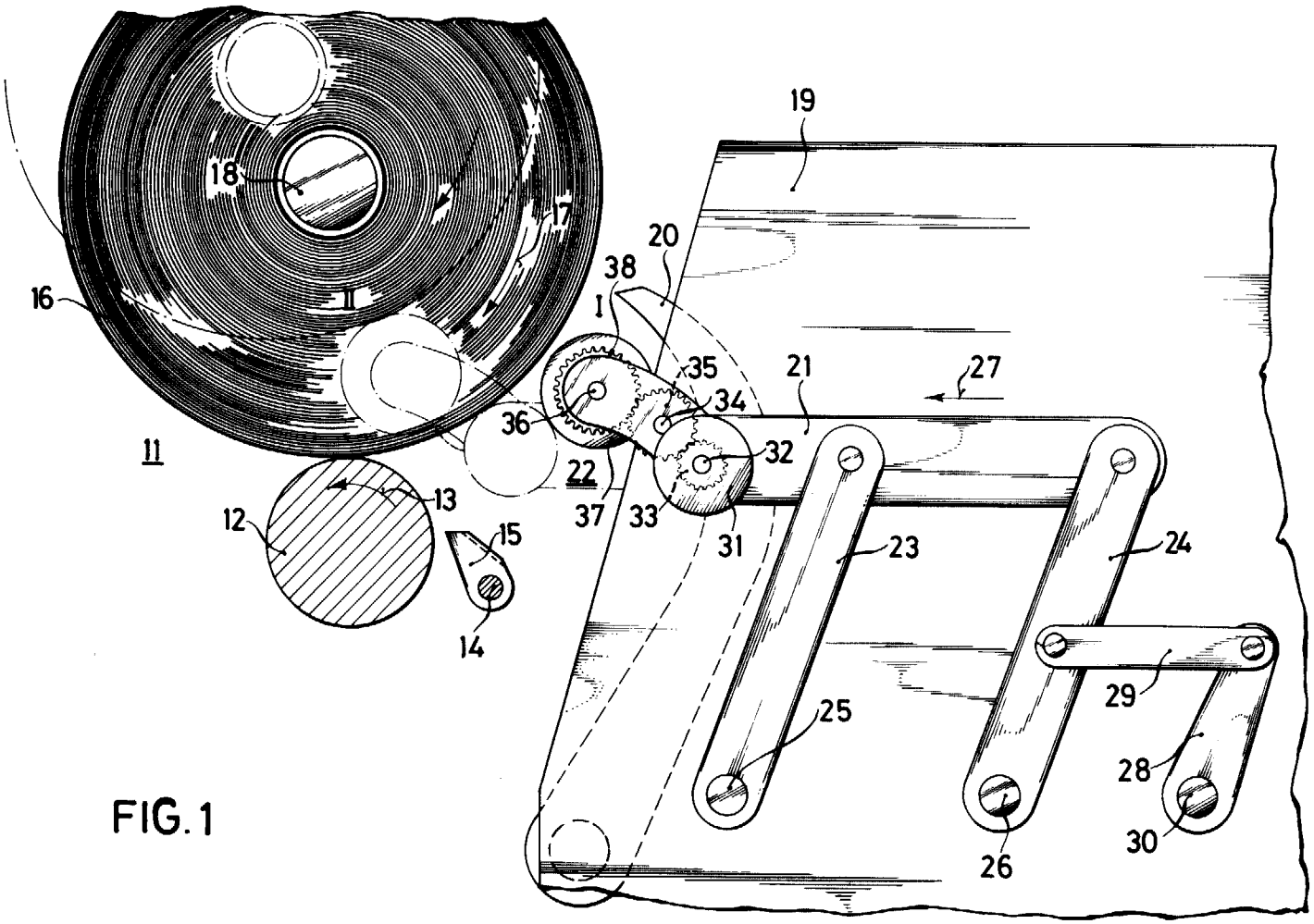

The invention relates to a device for adjusting a reverse or retrograde rotary motion in a coil being frictionally driven by a winding cylinder of winding equipment for textile coils or bobbins. Heretofore, such devices either had a separate drive for the reverse or retrograde operation of the coil or were formed of a simple friction roller or cylinder which was placed between the winding cylinder and the coil and which, by this means, reversed the direction of rotation of the coil while the peripheral speed remained the same.

A separate drive for the reverse or retrograde motion is very costly and, with a simple friction roller or cylinder, it is not possible to adjust, in a desired manner, the peripheral speed of the coil so that it is lower during the reverse or retrograde motion than during the rotary motion thereof in the winding direction.

It is accordingly an object of the invention to provide a device that is adjustable for forward rotary motion, idling and reverse or retrograde rotary motion without using a separate drive, and by the use of which the coil rotates more slowly during the reverse or retrograde rotary motion thereof than during the forward rotary motion thereof in the winding direction. Such a slower reverse or retrograde motion facilitates, for example, the seeking and finding of the thread end on the coil by mechanical and pneumatic means.

It is another object of the invention to provide such a device which requires no separate drive for reverse or retrograde running of the coil at reduced peripheral speed, and permits the rotation of the coil in the winding direction to slow down with the application of a brake additionally upon the coil or the reduction gearing, if necessary. A consequent object of the invention is, therefore, to provide such a device which assures a gentle transition from winding operation to reverse or retrograde operation. In contrast with a simple friction roller which, when inserted from the front of the winding equipment, always interferes with or encroaches upon the thread guidance range of the winding device, it is a further object of the invention to provide such a device which can always be mounted without difficulty on suitable means capable of traveling past a textile machine, on the front side thereof, and is insertable between the winding cylinder and the coil from the front.

Accordingly, it is an object of the invention to provide such a device which permits automatizing of thread seeking or finding, rewinding or thread joining processes in textile machines formed of a multiplicity of identical work stations.

With the foregoing and other objects in view, there is provided, in accordance with the invention, in winding equipment for textile coils, a device for adjusting retrograde rotary motion in a coil being frictionally driven by a winding cylinder, comprising reduction gearing, and means for inserting the reduction gearing between the winding cylinder and the coil.

In accordance with another feature of the invention, the reduction gearing comprises a pair of friction rollers, one of the rollers being rollable on the winding cylinder, and the coil being rollable on the other of the rollers.

In accordance with a further feature of the invention, the reduction gearing is adjustable to three positions, a first position wherein the reduction gearing is inoperative, a second position wherein one of the friction rollers of the reduction gearing has lifted the coil away from the winding cylinder, while the other of the friction rollers is not yet in contact with the winding cylinder, and a third position wherein the coil is in rolling contact with the one of the friction rollers, and the other of the friction rollers is in rolling contact with the winding cylinder.

In the second position the rotation of the coil can slow down, for example, in the winding direction before it is shifted into reverse or retrograde rotation in the third position.

In accordance with an additional feature of the invention, wherein the winding equipment includes a thread guide reciprocable within a given range, all parts of the reduction gearing except for the friction roller with which the coil is in rolling contact are located beyond the given range of reciprocation of the thread guide of the winding device. If the device according to the invention is switched to the second position or position II thereof, neither the thread being wound on the coil nor the reciprocating thread guide is disturbed. If the device is shifted to the third position or position III thereof, the winding of the thread ceases, of course, but also in this position, the reciprocating thread guide is not disturbed by the device according to the invention, if the parts of the reduction gearing are disposed in accordance with the invention, beyond the range of reciprocation of the thread guide.

If a thread end on the surface of the coil is to be sought out while the coil is rotating in reverse or retrograde, and if the thread end is then to be withdrawn from the coil, it is particularly advantageous when, in accordance with yet another feature of the invention, the friction roller contactable with the coil extends over only part of the length of the coil.

In accordance with a concomitant feature of the invention, the last mentioned friction roller has a conical end, over which a thread can readily slide off the respective friction roller.

Other features which are considered as characteristic for the invention are set forth in the appended claims.

Although the invention is illustrated and described herein as embodied in device for adjusting a retrograde rotary motion in a coil, it is nevertheless not intended to be limited to the details shown, since various modifications and structural changes may be made therein without departing from the spirit of the invention and within the scope and range of equivalents of the claims.

Figure 2:
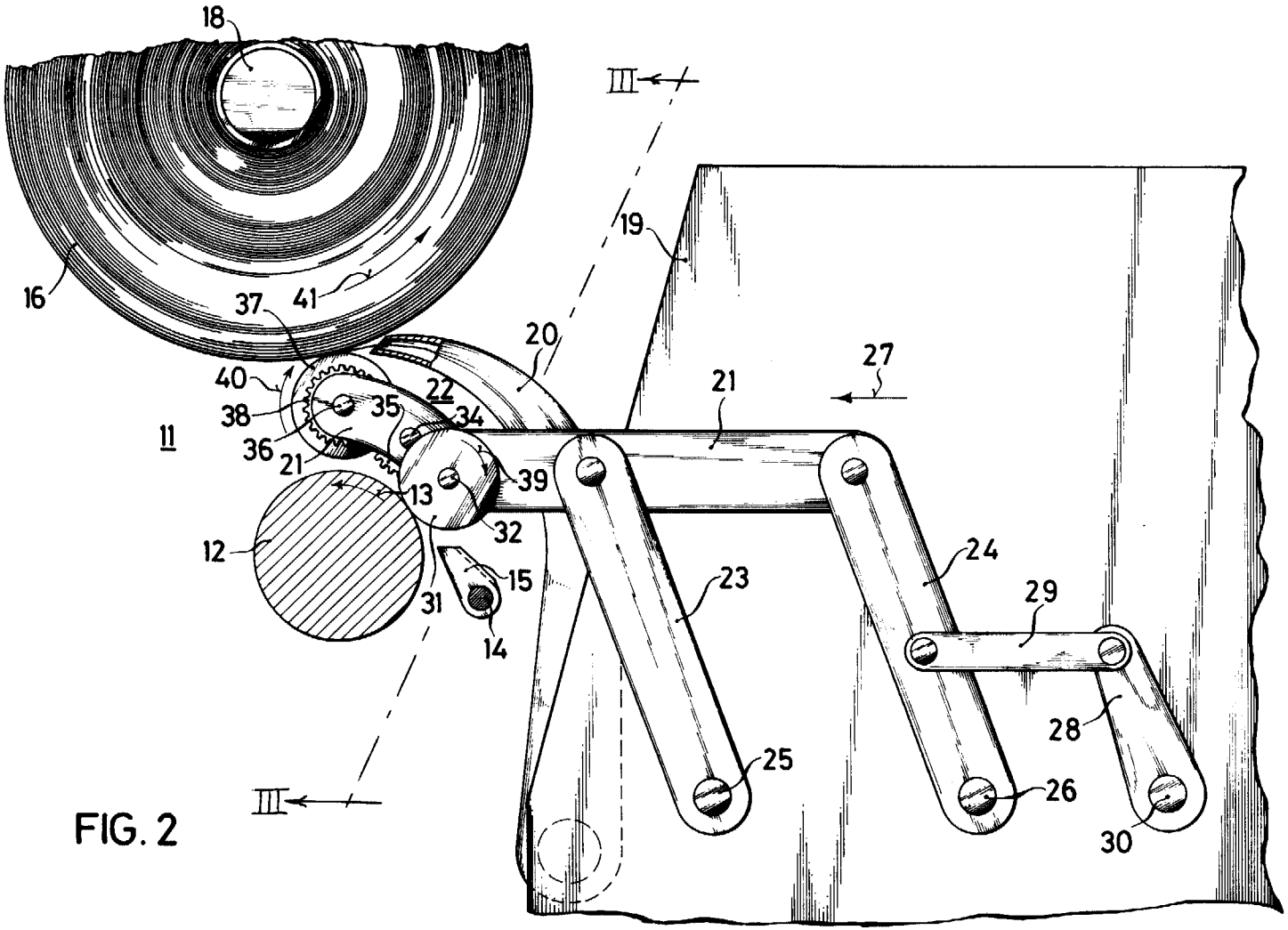
Figure 3:
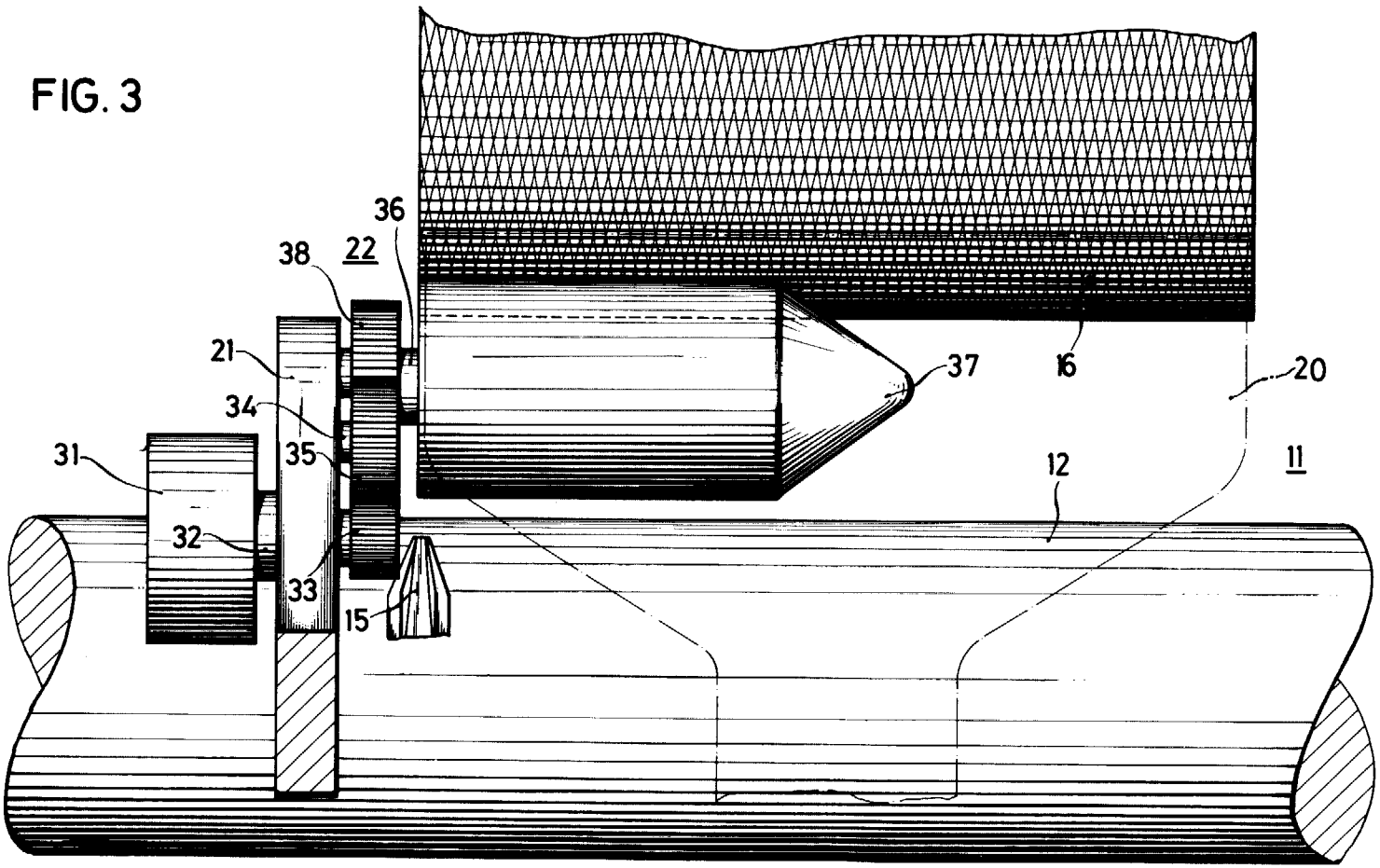

The construction and method of operation of the invention, however, together with additional objects and advantages thereof will be best understood from the following description of specific embodiments when read in connection with the accompanying drawing, in which:

FIGS. 1 and 2 are similar diagrammatic side elevational views of the device for setting a retrograde rotary motion of a coil at different phases of the operation thereof; and FIG. 3 is an enlarged sectional view of FIG. 2 taken along the line III—III in the direction of the arrows.

Referring now to the drawing and first, particularly, to FIG. 1 thereof, there is shown a winding device 11 which includes a winding cylinder 12, which rotates continuously in direction of of the arrow 13 at a constant speed of rotation. In front of the winding cylinder 12, a reciprocating thread guide 15 is disposed on a rod 14 which is movable in longitudinal direction thereof.

During normal operation, a coil 16 rolls on the winding cylinder 12 and is driven by the latter by means of friction. As viewed in FIG. 1, the coil 16 accordingly rotates in direction of the arrow 17 on a shaft 18, which is part of a non-illustrated movable coil holder.

The device according to the invention forms part of a carriage 19, which can travel past the front side of a textile machine having a multiplicity of identical winding devices. The carriage 19 carries a pivotable suction nozzle 20 for seeking or locating a thread end on the surface of the coil 16. At the carriage 19, there is further seen reduction gearing 22 mounted on an arm 21. The arm 21 is provided with parallel guidance through two straps 23 and 24 which are articulatingly connected to the arm 21 and are rotatable about two bearing shafts 25, 26 which are fixed to the carriage 19. The arm 21 can be moved out of the position thereof shown in FIG. 1 in the direction of the arrow 27 by means of the parallel guidance mechanism. This motion is imparted by a lever 28 in conjunction with an articulatingly suspended strap 29. The lever 28 is connected to a shaft 30, which can be rotated by a non-illustrated kinematic mechanism of any suitable construction which is located in the carriage 19.

When the arm 21 is located as shown in FIG. 1, the reduction gearing 22 is in position I. In this position, the reduction gearing 22, formed of a friction roller 31, a pinion 33 connected to the latter by a shaft 32, an intermediate gear 35 rotating on a shaft 34, and a gear 38 connected by the shaft 36 to a second friction roller 37, is not operative. If the arm 21 is moved in direction of the arrow 27, the friction roller 37 first comes into contact with the surface of the coil 16 and, during further travel thereof, lifts the coil off the winding cylinder 12 until the reduction gearing 22 has reached the position II shown in phantom in FIG. 1. In this latter position, the reduction gearing 22 is driven by the rolling coil 16 which is now slowing down. The friction roller 31 has made no contact as yet with the winding cylinder 12 in the position II of the reduction gearing 22. If the arm 21 is moved further yet in direction of the arrow 27, the reduction gearing 22 finally reaches the position III shown in FIG. 2. In position III, the friction roller 31 makes contact with the winding cylinder 12 is caused to rotate in direction of the arrow 39, while the friction roller 37 rotates with reduced peripheral speed in direction of the arrow 40, due to the particular step-down or reduction ratio selected, and drives the coil 16 in direction of the arrow 41. While the coil 16 slowly retrogrades or runs in reverse, the thread end can be found by means of the suction nozzle 20, which has been swung close to the surface of the coil, and can be sucked up as shown in FIG. 2. The limited length and the conical end of the friction roller 37, as clearly shown in FIG. 3, facilitates sliding of the thread end off during the motions of the suction nozzle 20 and the reduction gearing 22. In the interest of clarity, and to prevent obstruction of other structural features, the suction nozzle 20 is shown in phantom in FIG. 3.

There are claimed:

1. In winding equipment for textile coils, a device for effecting retrograde rotary motion in a coil being frictionally driven at a given rotary speed by a winding cylinder, comprising reduction gearing, and means for inserting said reduction gearing between the winding cylinder and the coil whereby both the rotary direction of the coil is reversed and the rotary speed thereof in the reverse direction is reduced.

2. Device according to claim 1 wherein said reduction gearing comprises a pair of friction rollers, one of said rollers being rollable on the winding cylinder, and the coil being rollable on the other of said rollers.

3. Device according to claim 2 wherein said reduction gearing is adjustable to three positions, a first position wherein said reduction gearing is inoperative, a second position wherein one of said friction rollers of said reduction gearing has lifted the coil away from the winding cylinder, while the other of said friction rollers is not yet in contact with the winding cylinder, and a third position wherein the coil is in rolling contact with said one of said friction rollers and said other of said friction rollers is in rolling contact with the winding cylinder.

4. Device according to claim 3 wherein the winding equipment includes a thread guide reciprocable within a given range and wherein all parts of said reduction gearing except for said friction roller with which the coil is in rolling contact are located beyond the given range of reciprocation of the thread guide of the winding device.

5. Device according to claim 3 wherein said friction roller contactable with the coil extends over only part of the length of the coil.

6. Device according to claim 5 wherein said friction roller contactable with the coil has a conical end over which a thread can readily slide off the respective friction roller.

* * * * *